United States Patent [19]

Culling

[11] Patent Number: 5,024,812

[45] Date of Patent: Jun. 18, 1991

[54] HYDROCHLORIC ACID RESISTANT STAINLESS STEEL

[75] Inventor: John H. Culling, St. Louis, Mo.

[73] Assignee: Carondelet Foundry Company, St. Louis, Mo.

[21] Appl. No.: 547,034

[22] Filed: Jul. 2, 1990

[51] Int. Cl.[5] ..... C22C 38/42; C22C 38/44

[52] U.S. Cl. ..... 420/49; 420/45; 420/52; 420/46

[58] Field of Search ..... 420/49, 45, 46, 47, 420/52, 53

[56] References Cited

U.S. PATENT DOCUMENTS 4,078,920 3/1978 Liljas et al. ..... 420/49

FOREIGN PATENT DOCUMENTS 61-87855 5/1986 Japan ..... 420/46

*Primary Examiner*—Deborah Yee

*Attorney, Agent, or Firm*—Senniger, Powers, Leavitt & Roedel

[57] ABSTRACT

Single-phase, austenitic, stainless alloys which comprise, by weight, from about 13% to about 20% Ni, from about 13% to about 15% Cr, from about 7% to about 9% Mo, from about 0.5% to about 3.5% Cu, from about 0.06% to about 0.25% N, from about 0.2%, preferably from about 1%, up to about 4.5% Mn, up to about 0.08% C, up to about 2% Si, up to a total amount of about 1% of the common carbide-stabilizing elements columbium, tantalum and titanium, and the balance essentially iron, plus the usual impurities encountered in ordinary commercial steelmaking practice and found in common ferroalloys, scraps and melting materials.

10 Claims, No Drawings

HYDROCHLORIC ACID RESISTANT STAINLESS STEEL

BACKGROUND OF THE INVENTION

Hydrochloric acid is an important mineral acid which is corrosive and hazardous since it causes severe burns to human tissue. Hydrochloric acid also reacts with most metals to form explosive hydrogen gas. Concentrated hydrochloric acid is transported and stored in rubber-lined or polyester reinforced plastic tanks. Processes which use the aqueous acid are commonly carried out in glass-lined steel equipment involving obvious limitations and problems. Metals and alloys for handling hydrochloric acid are, therefore, very desirable, and suitable candidates are judged to be those with a corrosion rate under about 20 mils per year (MPY) when exposed to uncontaminated acid. In practice contamination is not uncommon and can cause catastrophic equipment failures. For example, acid recovered from the manufacture of fluorocarbons may contain over 0.5% hydrogen fluoride yet as little as 10 parts per million or less of fluorides may severely damage equipment made of glass-lined steel or the refractory metals, such as titanium, zirconium, columbium and tantalum.

Also, the presence of ferric ion in hydrochloric acid can drastically increase the corrosion of unalloyed zirconium, copper alloys, copper-nickel and nickel-copper alloys, as well as the nickel-molybdenum alloys known as Hastelloy B and B-2. Cupric ion behave somewhat similarly to ferric ion with all of the same metals and alloys. Aeration or contamination by other oxidizing substances will quickly result in failure of the Hastelloy B or B-2 alloys which otherwise have corrosion rates under 20 MPY in all concentrations of acid and temperatures up to the atmospheric boiling point in nonaerated acid and in the absence of oxidizing agents. Hydrochloric acid can also become contaminated with organic solvents when recovered as a by-product of a chlorination process. Even a few parts per million of organic contaminants can over a period of time, destroy rubber linings and certain plastics and elastomers.

Cast iron, containing over 14.3% silicon plus up to 3% molybdenum and 4% to 5% chromium, is suitable for all concentrations of hydrochloric acid to about 125° F., but is hard and extremely brittle. Nickel alloys containing about 9% silicon and 3% copper are slightly less brittle but still quite hard and suitable only for up to about 15% acid strengths at room temperature.

The commonly used austenitic stainless steels such as types 304 and 316, are not resistant to hydrochloric acid at any concentration and temperature. Higher nickel and molybdenum contents and, to a lesser extent, copper, in non-standard modified stainless steels impart some resistance to dilute acid, but pitting, local attack and stress corrosion cracking can still result. The commercial alloys known as Inconel 825 and Hastelloy G contain over 40% nickel and have useful resistance to all concentrations of hydrochloric acid below about 100° F. Inconel 625 contains about 62% nickel and the higher nickel has very good resistance to concentrated reagent grade acid at ambient temperatures. These alloys also contain chromium and molybdenum acid.

The most corrosion resistant of the nickel-base alloys to hydrochloric acid are Hastelloy B-2 (Ni-28Mo) and Hastelloy C-276 (Ni-16Cr-16Mo-3W). Alloy B-2 is excellent in the absence of oxidizing agents but quite expensive. Alloy C-276 shows less than 5 MPY attack in all concentrations of the acid at room temperature and less than about 20 MPY in all concentrations up to about 120° F., but it is also quite expensive.

Zirconium, titanium, tantalum, columbium, molybdenum and, to a considerably lesser extent, gold, silver and platinum, have all found some use in hydrochloric acid environments, but all are very expensive and present many fabrication and other problems. Carbon steels and standard ferritic stainless steels have no resistance to hydrochloric acid, while a few of the high-purity, proprietary, high-molybdenum stainless steels are useful for acid concentrations only up to about 1.5%. No duplex stainless steel has yet been developed with any significant usefulness in hydrochloric acid.

Thus there has remained a very keen interest in developing iron-base modified stainless steels of much lower nickel contents than the current nickel-base and related alloys but of useful resistance to hydrochloric acid as well as to local corrosion and stress corrosion cracking.

Molybdenum is the most effective addition element used in alloys to develop resistant to hydrochloric acid. Molybdenum, chromium and nitrogen all build resistance to local corrosion and stress corrosion cracking. Since molybdenum and chromium are both strong ferrite forming elements, use of large amounts of these elements together necessitate high nickel levels in order to maintain the required single phase austenitic, or face-centered-cubic, matrix crystal structure.

Spitz, U.S. Pat. No. 2,633,420, discloses alloys of more than 6% but not more than 20% each of chromium, nickel, copper and molybdenum, the sum being less than 50% and the remainder being substantially all iron. In the presence of these amounts of chromium and molybdenum such alloys (of less than 20% nickel content) will have a maximum of about 4.5% copper since that is all that can be retained in solid solution in a stable state. Therefore, all alloys of the composition ranges of elements specified by the '420 patent will contain some copper-rich precipitates, which render these alloys highly corrodible by hydrochloric acid. Alloys composed of most of the possible element ranges of proportions will contain other additional phases such as sigma, laves, alpha and carbides. Thus all alloYs of the '420 patent would be considered by modern standards to have very limited and poor corrosion resistance and of no practical usefulness to any concentrations of hydrochloric acid at any temperatures.

Alloys that resist general attack by hydrochloric acid rather well but are still susceptible to local corrosion and stress corrosion cracking remain impractical for hydrochloric acid service. Many alloys withstand general surface attack in some HCl acid strengths (usually dilute) but still fail from local corrosion or stress corrosion cracking, thought to be the result of corrosion products formed, particularly $FeCl_3$. On the other hand, alloys of modest or low nickel contents have been developed that resist chloride local attack and stress corrosion cracking very well but are still not especially resistant to hydrochloric acid. Examples of such alloys are disclosed in Hatfield, U.S. Pat. No. 2,402,814, Rassomme et al, U.S. Pat. No. 4,421,557, Baumel, U.S. Pat. No. 3,726,668, Abo et al, U.S. Pat. No. 4,172,716 and the Japanese patent J57016-153, all of which disclose alloys containing less than 6%–7% molybdenum. There have also been many patents disclosing duplex stainless steel which contain up to about 6% Mo, such as Yamaguchi et al, U.S. Pat. No. 4,141,762. But, as noted above, duplex stainless steels do not resist hydrochloric acid well.

Kudo et al, U.S. Pat. No. 4,400,349, claims alloys of 20–60% Ni, 15–35% Cr, 0–12 Mo, 0–24% Cr, 3–20% Mn plus iron and other elements. The exemplary alloys all contain between 20.7% and 59.6% Ni, while those having a molybdenum content range of 7–9% also contain 16.2% to 29.2% Cr, necessitating the inclusion of a combined nickel plus manganese content of 30.3% to 50.1% in order to maintain structural stability.

Fleischmann, U.S. Pat. No. 2,398,702, claims copper-free heat resistant alloys of up to 0.15% carbon, 4–8% Mo, 12–20% Cr and nickel in an amount such as to render the alloys austenitic alloys included in that patent, such as the alloy known as 16-25-6, contain precipitated carbides and are of generally poor corrosion resistance.

Japanese patent J5 7171-651 claims alloys of 4–8% Mo, 18–25% Cr, 20–30% Ni, 0.3–3% Cu and lanthanum plus cerium in addition to iron and other elements. The exemplary alloys are essentially of the 25% Ni, 20% Cr, 6% Mo type.

Liljas et al, U.S. Pat. No. 4,078,920, claims alloys of 17–25% Cr, 15–21% Ni, 6–10% Mo, up to 2% Cu, up to 1% Mn and the remainder iron plus carbon, nitrogen, silicon and impurities. The commercial alloy covered by this patent is known as 254SMo and nominally contains 18% Ni, 20% Cr, 6.1% Mo, 0.8% Cu, 0.20% Ni, 0.5% Mn, and the balance essentially iron. Liljas specifies a maximum of 2% Mn and states that a maximum of 1% Mn is preferred. My patent U.S. Pat. No. 4,818,483, discloses alloys which are an improvement over the alloYs of Liljas and contain ranges of elements otherwise similar to the alloys of Liljas except for a 3–8% Mn content. Alloys of both '920 and '483 possess good resistance to many chlorides but not very good resistance to hydrochloric acid.

Thus it has remained desirable to develop alloys of good mechanical properties and good resistance to hydrochloric acid but containing a nickel content of 20% or lower instead of in the 40–60% Ni range of prior art alloys.

SUMMARY OF THE INVENTION

It is therefore an object of this invention to provide low nickel iron-base alloys for many applications of hydrochloric acid service heretofore only fulfilled by high-nickel, nickel-base, or other very expensive alloys. An additional object is to provide such alloys that are soft, ductile, weldable, formable and capable of being produced in air by ordinary methods and equipment without the requirement of special sands, furnace linings or inert atmospheres. Yet another object is to provide such alloys that retain their corrosion resistance in ordinarily chemically reducing hydrochloric acid that may also contain such oxidizing contaminants as ferric ions and salts, cupric ions and salts, dissolved air or oxygen, nitric acid, nitrates, sulfuric acid, sulfates, nitrites and others.

Those and other objects are fulfilled, according to this invention, by providing single-phase, austenitic, or face-centered-cubic crystal structure, stainless alloys which comprise, by weight, from about 13% to about 20% Ni, from about 13% to about 15% Cr, from about 7% to about 9% Mo, from about 0.5% to about 3.5% Cu, from about 0.06% to about 0.25% N, from about 0.2%, preferably from about 1%, up to about 4.5% Mn, up to about 0.08% C., up to about 2% Si, up to a total amount of about 1% of the common carbide-stabilizing elements columbium, tantalum and titanium, and the balance essentially iron, plus the usual impurities encountered in ordinary commercial steelmaking practice and found in common ferroalloys, scraps and melting materials.

DETAILED DESCRIPTION OF THE INVENTION

The present invention is directed to essentially single phase, austenitic, solid solution alloys which can readily be used to provide cast, forged and wrought forms and shapes.

The major components of the alloys of the invention are:

| | |
|---|---|
| Nickel | 13–20% by weight |
| Chromium | 13–15% |
| Molybdenum | 7–9% |
| Copper | 0.5–3.5% |
| Manganese | 0.2–4.5% |
| Nitrogen | 0.06–0.25% |
| Iron | essentially balance |

Nominally these alloys of the invention will also contain carbon, up to a maximum of about 0.08% by weight.

Optionally the alloys of the invention may further contain:

| | |
|---|---|
| Silicon | up to 2% |
| Columbium, Tantalum and Titanium | up to 1% (Total of the three) |
| Cobalt | up to 0.6% |
| Rare earth component | up to 0.3% |

According to ht invention it has been found that, at a given molybdenum level, there is a pronounced reduction in the rate of hydrochloric acid attack starting at about the 12% Ni level and continuing up to about the 18–20% Ni level. Further increases in nickel content only modestly decrease the rate of hydrochloric acid attack per unit increase in nickel. For examPle, an alloy of 8% Mo, 4% Ni, and the balance substantially iron, in a two day exposure period in 20% hydrochloric acid at room temperature averaged about 160 MPY attack rate. At 17% Ni with the same 8% Mo in an iron base, the attack rate was about 9.4 MPY, while a further increase to 50% Ni with the same 8% Mo content and balance iron only reduced the attack rate to about 7 MPY. As discussed above, a main object of this invention is to produce alloys of good resistance to hydrochloric acid at the lowest practical nickel. Thus it has been found that for alloys of 7–9% Mo an optimum reduction in corrosion rate with minimum nickel content occurs in alloys with about 13% to about 20% Ni by weight. Less than about 13% Ni does not provide useful resistance except in very dilute acid strengths and the use of more than about 20% Ni is wasteful. A content of about 16% Ni is the preferred minimum level, providing very reduced corrosion rates for alloys of the invention in hydrochloric acid.

Extensive testing of experimental alloys has also shown that for the desired relatively low nickel contents of the alloys of the invention a minimum content of about 7% Mo is required to provide good resistance to hydrochloric acid. A higher molybdenum content further reduces the rates of attack, but molybdenum is a very strong ferritizing element. Since the presence of substantial quantities of ferritic (or non-austenitic) phases increase hardness, decrease ductility, weldability, fabricability and toughness and drastically reduce resistance to hydrochloric acid, alloys of the invention have been balanced compositionally to include a maximum of about 9% Mo by weight.

Molybdenum and nickel are the two most important elements in imparting resistance to pure hydrochloric acid which is chemically non-oxidizing. However, if an oxidizing substance is present, chromium and nitrogen become important as well. Such an oxidizing substance might be a chloride, such as ferric chloride, cupric chloride, or other products of corrosion of the alloy itself. Resistance to chlorides is principally dependent upon the content of molybdenum, nitrogen and chromium. Also, resistance to pitting and crevice corrosion and stress corrosion cracking are dependent upon these three elements, with a widely accepted guide of resistance to these types of corrosion being proportional to Cr plus 3.3×% Mo plus 16×% N=Guide. This guide for alloys of the invention is from about 37 to about 49 numerically, with values of about 42 to about 48 being the preferred range. There is some maximum concentration of chloride ion at some minimum pH level at some temperature for every known alloy beyond which local corrosion or stress corrosion failure will take place, but alloys of the 42 to 48 guide indices would be considered as excellent in most practical applications by those skilled in the art.

It has also been found that alloys of the invention having less than about 13% Cr content by weight may have good resistance to broad surface attack by hydrochloric acid but tend to suffer pitting or crevice corrosion attack over long periods of exposure. Also, both local corrosion and broad surface corrosion are increased by the presence of even small amounts of one or more of several likely impurities. Therefore alloys of the invention, which are designed for long term use and for the presence of various impurities contain a minimum of about 13% Cr by weight.

Chromium is also a strong ferritizing element and amounts larger than about 15% are of no further significant benefit until levels of about 23% are reached. Since alloys of the invention must be essentially of austenitic, face-center-cubic matrix crystal structure, chromium is limited to about 15% maximum by weight, larger amounts tending to destabilize the alloys metallurgically.

Because of the low nickel contents of the alloys of the invention and because of the total content of molybdenum and chromium other austenite forming and stabilizing elements are required. Cobalt could provide this function, but it behaves about like nickel and is much more expensive. Therefore the only cobalt in alloys of the invention is that which is found naturally in certain nickel ores or what might be picked up as an impurity in various scraps or other melting stocks. Thus, in typical alloying practice, cobalt has been found not to exceed about 0.6% by weight and no detrimental effect has been found at least up to these levels. In actual practice Cobalt is chemically a sister element to nickel and the contents of both elements combined are reported in the exemplary alloys of the invention as nickel content.

Carbon and nitrogen are both very powerful austenite stabilizers, but the presence of large amounts of carbon present sever corrosion problems, the most widely encountered being intergranular attack. Like most stainless steels, therefore, alloys of the invention are limited to a maximum of about 0.08% C by weight. In applications in which intergranular attack might take place it is preferable that alloys of the invention either contain a maximum of about 0.03% C or contain up to a maximum of about 1% total of the usual carbide stabilizing elements, columbum, tantalum and titanium applied in the usual prescribed manner that has been employed in stainless steel making since about 1940. It is undesirable for alloys of the invention to contain more than about 1% total of the carbide stabilizing elements because they are all ferrite-forming elements and must be used in relatively low amounts to keep the alloys of the invention in a substantially austenitic matrix crystal structure.

Nitrogen enhances ,resistance to local corrosion and stress corrosion cracking and is a powerful austenitizer, but must not exceed its solid solubility if sound metal is to be produced. Therefore, a minimum of about 0.06% N by weight has been found to be required for corrosion resistance, while a maximum of about 0.25% N is the upper limit of solubility in alloys of the invention.

Manganese, molybdenum and chromium all increase solid solubility for nitrogen, while nickel decreases it. Manganese also favors the austenitic matrix crystal structure. Alloys of the invention with only moderate resistance to hydrochloric acid due to carbon at the high end of the range and molybdenum at the low end may contain as little as about 0.2% Mn. However, the preferred alloys of the invention, with good resistance to hydrochloric acid, should contain a minimum of about 2% Mn in order to maintain structural stability at the preferred maximums of 0.03% carbon and about 7% to 9% Mo. However, alloys of the invention contain a maximum of about 4.7% Mn, because alloys of higher manganese contents form substantial amounts of undesirable manganese oxide on the surface of the molten bath. Manganese oxide is a basic substance and begins to attack the usual acid linings of furnaces widely employed in producing alloys of the instant type as well as the also acidic, ordinary silica molding sands generally employed. Thus castings produced with alloys of greater than about 4.7% Mn contents have a porous defective surface. It is possible to produce alloys of higher manganese contents in furnaces lined with basic refractories and to cast them in special sands. But this is all needlessly troublesome and expensive since the preferred range of about 2% to 4% Mn accomplishes the desired effects in alloys of the invention.

Alloys of the invention contain a minimum of about 0.5% Cu, which has been found to be sufficient to aid in the passivation of the alloys in the presence of dissolved air. Copper-rich precipitates out of the solid solution of the matrix are very damaging to resistance to hydrochloric acid and many other substances. Alloys of the invention are able to retain up to about 3.5% Cu in solid solution, so that they contain from about 0.5% to abut 3.5% Cu by weight.

Silicon up to about 2% is found in many, if not most, cast corrosion resistant alloys. Silicon and manganese are both commonly employed together in steel making practice as low cost deoxidizing agents. In the presence of the high chromium found in alloys of the invention and particularly in the additional presence of relatively high manganese contents in the preferred alloys of the invention, silicon is not actually required and may generally be ignored. However, silicon is a ferrite forming element and is therefore restricted to a maximum of about 2% and preferable a maximum of about 1% by weight.

A rare earth component consisting of cerium, lanthanum or other rare earth elements, often introduced to the alloys in the form of mischmetal, a mixture of rare earths plus small amounts of impurities, is now commonly added to many heat and corrosion resistant alloys to enhance fabricability. It may be so employed without detriment to alloys of the invention.

For optimum resistance to relatively pure or contaminated hydrochloric acid it has been found preferable to restrict the alloys of the invention to the following elements and to the ranges of proportions indicated:

| | |
|---|---|
| Nickel | 16–20% By Weight |
| Chromium | 13–15% |
| Molybdenum | 8–9% |
| Copper | 0.5–3.5% |
| Manganese | 2–4% |
| Nitrogen | 0.12–0.20% |
| Silicon | 0.2–1% |
| Carbon | 0–0.03% |
| Cobalt | 0–0.6% |
| Columbium, Tantalum and Titanium | 0–1% Total |
| Rare Earth Component | 0–0.3% |
| Iron | essentially balance |

A particularly advantageous alloy has the following composition:

| | |
|---|---|
| Nickel | 19% By Weight |
| Chromium | 14% |
| Molybdenum | 8.5% |
| Copper | 1% |
| Manganese | 3% |
| Nitrogen | 0.15% |
| Silicon | 0.2–1% |
| Carbon | 0.02% |
| Iron | essentially balance |

The following examples further illustrate the invention:

EXAMPLE 1

One hundred pound heats of several different alloys were prepared in accordance with the invention. One hundred pound heats of other alloys were also prepared.

Each of the heats was air-melted in a 100-pound high frequency induction furnace. The composition of the alloys of the invention is set forth above the dashed line of Table I, while the composition of several alloys not of the invention is set forth below the dashed line of Table I, with the balance in each instance being essentially iron.

Alloy 1534 was prepared in accordance with the specifications for Inconel 625, while alloy 1538 was prepared as an example of Hastelloy C.

TABLE I

| Alloy Number | Other Designation | Ni | Cr | Mo | Cu | Mn | N | C | Si | Other |
|---|---|---|---|---|---|---|---|---|---|---|
| | | ALLOYS BY WEIGHT PERCENTAGES OF ALLOYING ELEMENTS | | | | | | | | |
| 1533 | — | 18.13 | 14.42 | 8.25 | 1.31 | 3.65 | 0.14 | 0.03 | 0.62 | — |
| 1535 | — | 17.44 | 14.18 | 8.61 | 0.68 | 2.28 | 0.17 | 0.03 | 0.56 | — |
| 1536 | — | 17.10 | 13.44 | 7.33 | 2.27 | 2.43 | 0.11 | 0.02 | 0.67 | — |
| 1537 | — | 19.22 | 14.73 | 8.21 | 1.06 | 2.05 | 0.15 | 0.02 | 0.62 | — |
| 1539 | — | 19.81 | 13.93 | 8.91 | 1.22 | 3.79 | 0.21 | 0.02 | 0.46 | — |
| 1534 | 625 | 63.23 | 22.13 | 9.18 | — | 0.36 | — | 0.06 | 0.55 | 3.82 Cb + Ta |
| 1538 | HASTELLOY C | 54.64 | 15.61 | 16.22 | — | 0.66 | — | 0.02 | 0.21 | 3.29 W |
| 1540 | SRIIA 1132 | 14.09 | 11.44 | 6.53 | 6.44 | 0.61 | — | 0.08 | 0.28 | — |
| 1541 | 20Cb3 | 33.33 | 20.06 | 2.49 | 3.26 | 1.15 | — | 0.04 | 0.26 | 0.62 Cb |
| 1542 | DUPLEX | 4.23 | 25.38 | 1.54 | — | 0.66 | 0.16 | 0.02 | 0.72 | — |
| 1543 | 316 | 13.11 | 17.29 | 2.43 | — | 1.14 | — | 0.05 | 0.26 | — |
| 1544 | NSCD | 16.23 | 17.11 | 5.03 | 0.28 | 0.83 | — | 0.02 | 0.26 | — |
| 1545 | 20 | 24.23 | 20.61 | 2.02 | 3.21 | 0.96 | — | 0.05 | 0.72 | — |
| 1546 | 3D48 | 19.52 | 17.61 | 7.34 | — | 1.54 | 0.02 | 0.01 | 0.44 | 0.025 La |
| 1547 | 254SMO | 18.08 | 20.13 | 6.21 | 0.83 | 0.62 | 0.19 | 0.02 | 0.45 | — |
| 1548 | NKTM7 | 16.32 | 9.62 | 6.17 | — | 0.89 | — | 0.02 | 0.61 | — |

With reference to the other prior art alloys in Table I, alloy 1540 corresponds to the commercial alloy, SRIIA 1132, covered by the patent to Spitz, U.S. Pat. No. 2,633,420; alloy 1541 conforms to alloy 20Cb3, covered by Scharfstein U.S. Pat. No. 3,168,397, while alloy 1542 is typical of current duplex stainless steels and 1543 conforms to standard type 316 stainless steel. Alloy 1545 conforms to the older alloy 20 from Parsons U.S. Pat. No. 2,185,987. Alloy 1546 duplicates Alloy 3D48 of Rossome et al, U.S. Pat. No. 4,421,557, except that a two-ounce ball of mischmetal was added to the melt to provide the lanthanum content of 3D48. The mischmetal contained about 50% cerium and 24% lanthanum. When added in this fashion to the furnace employed this procedure has resulted in the past in a recovery of approximately half of the added rare earth components by weight. Accordingly, the final alloys could contain about 0.015% La and about 0.03% Ce, although analyses for these two elements were not tested in the castings produced from the actual heat. Rossomme's alloy 3D48 was chosen for this comparison because it was ranked in the first position in Table II of the '557 patent. Alloy 1547 was made up in accordance with Liljas U.S. Pat. No. 4,078,920 and alloy No. 1548 was made up in accordance with the commercial alloy NKTM7, which is somewhat similar to the alloys of the invention.

All of the alloys of the invention were tested in three conditions, as cast, solution annealed for 4 hours at 1925° F. followed by an oil quench, and annealed at 1650° F. for 4 hours followed by a slow cool in the furnace. Samples were then tested by magnetic permeability indicator gage, and all were found to register less than 0.7% ferrite, the lowest gage available. All samples were also read as less than 1.01 magnetic permeability by the appropriate set of gages. Micrographic samples were also prepared from each of the test alloys of the invention in each of the conditions of heat treatment and examined at various magnifications from 100X to 375X. No ferrite was observed in any of the samples. These tests demonstrate the metallurgical stability of the alloys of the invention.

Standard tensile test bars were machined from each of the heats of the alloys of the invention and tensile tests were conducted. Also each heat was measured for hardness. The results of these tests are set forth in Table II.

TABLE II

MECHANICAL PROPERTIES OF ALLOYS OF THE INVENTION

| Alloy Number | Tensile Strength P.S.I. | Yield Strength P.S.I. | % Elongation | % Reduction of Area | Brinell Hardness Number |
|---|---|---|---|---|---|
| 1533 | 72,900 | 33,500 | 21.0 | 18.1 | 176 |
| 1535 | 79,700 | 42,500 | 15.0 | 15.9 | 179 |
| 1536 | 72,600 | 33,100 | 24.1 | 21.1 | 143 |
| 1537 | 73,900 | 43,200 | 19.0 | 16.9 | 187 |
| 1539 | 77,900 | 46,300 | 12.5 | 11.9 | 192 |

EXAMPLE 2

Cast corrosion bars for both alloys of the invention and not of the invention were machined into 1½ inch diameter by ¼ inch thick discs, each disc having a ⅛ inch diameter hole in the center. These discs were then ground to a 240 grit finish and cleaned of all oil and dust particles in a 1,1,1-trichloroethane solution, then washed with a nylon bristle brush in a hot solution of tap water and dish detergent, rinsed, and dried on a hot plate at 120° C. (248° F.). Each disc was weighed to the nearest 10,000th of a gram. These discs were then used in the comparative corrosion tests described hereinafter.

The discs were suspended by platinum wires for a period of two days in 600 milliliters of 5%, 10%, 20% and 30% hydrochloric acid/water solutions at room temperature. The solutions were contained in beakers covered with watch crystals.

Each disc was then scrubbed with a nylon bristle brush under running water to remove corrosion products, soaked in 1000 ml of hot tap water at a temperature of 80° C. (176° F.) for about two hours to dissolve any possible remnants of chlorides, rerinsed, then dried on a hot plate for about an hour at about 120° C. (248° F.). Each specimen was then weighed again to the nearest 10,000th of a gram and the weight loss recorded. The weight loss was converted to a figure of average depth of penetration in mils per year, MPY, in accordance with the relationship:

$$MPY = 393.7 \frac{Wo - Wf}{ATD}$$

The results of these tests are set forth in Table III.

Discs were also tested for two days at 100° F. in the four hydrochloric acid/water solutions. The results of these tests are also set forth in Table III.

TABLE III

WEIGHT LOSS IN MPY IN HYDROCHLORIC ACID/WATER SOLUTIONS

| Alloy Number | ROOM TEMPERATURE 5% | 10% | 20% | 30% | 100° F. (38° C.) 5% | 10% | 20% | 30% |
|---|---|---|---|---|---|---|---|---|
| 1533 | 6.9 | 8.4 | 9.4 | 12.9 | 11.9 | 14.7 | 15.7 | 23.2 |
| 1535 | 5.7 | 7.8 | 8.8 | NT | 9.6 | 12.5 | 14.9 | NT |
| 1536 | 6.8 | 8.4 | 10.2 | 13.3 | 11.1 | 15.1 | 18.9 | 27.8 |
| 1537 | 5.6 | 7.5 | 8.7 | 11.1 | 9.4 | 12.1 | 15.3 | 19.1 |
| 1539 | 5.2 | 7.6 | 7.8 | 10.6 | 8.3 | 12.3 | 13.3 | 18.8 |
| 1534 | 14.4 | 13.7 | 9.2 | NT | 23.3 | 25.3 | 16.3 | NT |
| 1538 | .4 | 2.6 | 3.3 | NT | 3.1 | 12.8 | 9.1 | NT |
| 1540 | 8.7 | 16.9 | 21.7 | 33.6 | 16.2 | 24.7 | 43.2 | 67.8 |

TABLE III-continued

WEIGHT LOSS IN MPY IN HYDROCHLORIC ACID/WATER SOLUTIONS

| Alloy Number | ROOM TEMPERATURE 5% | 10% | 20% | 30% | 100° F. (38° C.) 5% | 10% | 20% | 30% |
|---|---|---|---|---|---|---|---|---|
| 1541 | 10.7 | 12.8 | 14.5 | 22.2 | 20.9 | 25.1 | 27.2 | 44.6 |
| 1542 | NT | NT | 255.2 | NT | NT | NT | 637.7 | NT |
| 1543 | NT | 33.5 | 108.6 | NT | NT | 86.2 | 332.2 | NT |
| 1544 | NT | 12.3 | 14.2 | 20.3 | NT | 77.7 | 257.6 | 663.3 |
| 1545 | NT | 17.2 | 18.5 | 25.6 | NT | 23.1 | 71.3 | 126.5 |
| 1546 | NT | 13.3 | 14.7 | 24.3 | NT | 47.7 | 229.2 | 387.6 |
| 1547 | 8.7 | 10.3 | 11.8 | 18.6 | 16.3 | 24.4 | 27.8 | 38.6 |
| 1548 | 9.4 | 12.1 | 13.2 | 18.7 | 15.6 | 20.5 | 23.8 | 35.6 |

NT = NOT TESTED

Since alloys with corrosion rates under about 20 MPY in strong hydrochloric acid solutions are judged to be candidates for this service, it is obvious that even the least resistant alloys of the invention have useful resistance up to 30% acid at room temperature, while the best alloys of the invention are suitable for service at least to 30% acid at 100° F. (38° C.). The better alloys of the invention have resistances in acid strengths up to 20% that are equal or superior to the nickel-base alloy, Inconel 625 (1534) at room temperature.

EXAMPLE 3

Since alloys of the invention are intended for use in hydrochloric acid solutions containing oxidizing impurities, discs, as employed in the tests of Example 2 above, were tested for two days at 100° F. (38° C.) in the same strengths of hydrochloric acid/water solutions used in Example 2 except that each solution also contained 5% nitric acid, a very strong oxidizer. For comparison a disc of alloy 1548 was also tested. The results of these tests are set forth in Table IV.

TABLE IV

WEIGHT LOSS IN MPY IN HYDROCHLORIC ACID/WATER SOLUTIONS PLUS 5% NITRIC ACID AT 100° F. (38° C.)

| Alloy Number | 5% | 10% | 20% | 30% |
|---|---|---|---|---|
| 1533 | 4.8 | 7.8 | 11.8 | 19.2 |
| 1535 | 5.2 | 8.4 | 12.1 | 17.6 |
| 1536 | 3.9 | 6.2 | 11.2 | 16.7 |
| 1537 | 4.1 | 7.3 | 10.2 | 18.6 |
| 1539 | 5.1 | 8.8 | 9.3 | 15.8 |
| 1548 | 35.7 | 66.3 | 149.7 | 188.2 |

In alloys that contain sufficiently high chromium contents and exhibit active-passive behavior, the addition of nitric acid or nitrates to hydrochloric acid solutions reduces the corrosion rates which occur when using hydrochloric acid/water solutions free of nitric acid. The alloys of the invention also demonstrate this ability as opposed to the drastic increase in attack by the nitric acid or nitrate additions characteristic of such chromium-free or very low-Cr alloys as Hastelloy B, nickel alloys and alloys of the type represented by alloy 1548.

EXAMPLE 4

Although alloys of the invention were developed to provide iron-base alloys of good resistance to hydrochloric acid, they also display excellent resistance to other chloride solutions.

Alloys of the invention in the as cast, in the slow annealed and in the solution annealed plus oil quenched conditions were all held for 160 days at 122° F. (50° C.) in a solution of 4 ounces of ordinary table salt per gallon of ordinary tap water. In a manner similar to Example 2 above, each disc was suspended by a platinum wire in 600 ml of the salt solution contained in a beaker with a watch crystal cover. The discs were then cleaned and carefully weighed again. They were also carefully examined for pits under a ten power magnifying glass.

None of the samples of the alloys of the invention in any of the three conditions of heat treatment displayed weight losses over about 0.02 MPY, and no pits were found on any of the samples.

These tests were duplicated with additional samples in the same manner except that ½% of nitric acid was also added to the chloride-water solution. The results were the same in both the absence of pits and the rate of attack being less than about 0.02 MPY for all samples.

EXAMPLE 5

Sample discs of alloy 1533 of the invention were further tested in a manner similar to Example 2 above by suspending them by platinum wires in 600 ml of various solutions in watch crystal covered beakers held at various temperatures for various periods of time either on a controlled hot plate or at room temperature on a laboratory counter.

These discs were cleaned and reweighed as in Example 2 and weight losses calculated in MPY surface attack. The various conditions and results of these tests are set forth in Table V.

These tests represent a broad spectrum of corrosive conditions and demonstrate that alloys of the invention have good resistance to many other substances beside hydrochloric acid.

TABLE V

CORROSION RATE IN MPY OF ALLOY 1533 IN VARIOUS SOLUTIONS AND CONDITIONS

| | |
|---|---|
| 86% | phosphoric acid, 122° F., 4 days - nil |
| 86% | phosphoric acid plus 4 ounces of sodium chloride per gallon, 122° F., 6 days - 5.3 MPY |
| 35% | nitric acid, 122° F., 2 days - 0.2 MPY |
| 37% | nitric acid, 176° F., 2 days - 5.3 MPY |
| 15% | sulfuric acid plus 15% nitric acid plus 3% hydrochloric acid, 100° F., 2 days - 7.2 MPY |
| 15% | sulfuric acid plus 15% nitric acid, 122° F., 2 days - 1.3 MPY |
| 25% | sulfuric acid, 176° F., 2 days - 8.0 MPY |
| 25% | sulfuric acid plus 2.5% sodium chloride, room temperature, 4 days - 6.7 MPY |
| 40% | sulfuric acid, 122° F., 2 days - 3.2 MPY |
| 97% | sulfuric acid, room temperature, 6 days - 1.6 MPY |
| 97% | sulfuric acid, 122° F., 2 days - 2.6 MPY |
| 97% | sulfuric acid, 176° F., 2 days - 4.1 MPY |

As various changes could be made in the above alloys without departing from the scope of the invention, it is intended that all matter contained in the above description shall be interpreted as illustrative and not in a limiting sense.

What is claimed is:

1. A low nickel content alloy having good resistance to hydrochloric acid comprising:

| | |
|---|---|
| Nickel | 13–20% by weight |
| Chromium | 13–15% |
| Molybdenum | 7–9% |
| Copper | 0.5–3.5% |
| Manganese | 0.2–4.5% |
| Nitrogen | 0.06–0.25% |
| Carbon | up to about 0.08% maximum |

-continued

| | |
|---|---|
| Iron | essentially balance. |

2. An alloy of claim 1 further comprising:

| | |
|---|---|
| Silicon | up to 2% by weight |
| Columbium, Tantalum and Titanium | up to 1% (total of the three) |
| Cobalt | up to 0.6% |
| Rare earth component | up to 0.3%. |

3. An alloy of claim 2 wherein:

| | |
|---|---|
| Nickel | 16–20% by weight |
| Chromium | 13–15% |
| Molybdenum | 7–9% |
| Copper | 0.5–3.5% |
| Manganese | 2–4% |
| Nitrogen | 0.12–0.20% |
| Silicon | 0.2–1% |
| Carbon | 0–0.3% |
| Cobalt | 0–0.6% |
| Columbium, Tantalum and Titanium | 0–1% Total |
| Rare earth component | 0–0.3% |
| Iron | essentially balance. |

4. An alloy of claim 3 wherein nickel is 17–20%, chromium is 14–15%, and molybdenum is 8–9%, all by weight.

5. An alloy of claim 4 wherein:

| | |
|---|---|
| Nickel | 19% by weight |
| Chromium | 14% |
| Molybdenum | 8.5% |
| Copper | 1% |
| Manganese | 3% |
| Nitrogen | 0.15% |
| Silicon | 0.2–1% |
| Carbon | 0.02% |
| Iron | essentially balance. |

6. An alloy of claim 3 wherein:

| | |
|---|---|
| Nickel | About 18% by weight |
| Chromium | About 14.5% |
| Molybdenum | About 8% |
| Copper | About 1.5% |
| Manganese | About 3.5% |
| Nitrogen | About 0.15% |
| Carbon | About 0.03% |
| Silicon | About 0.6%. |

7. An alloy of claim 3 wherein:

| | |
|---|---|
| Nickel | About 17.5% by weight |
| Chromium | About 14% |
| Molybdenum | About 8.5% |
| Copper | About 0.7% |
| Manganese | About 2.5% |
| Nitrogen | About 0.15% |
| Carbon | About 0.03% |
| Silicon | About 0.6%. |

8. An alloy of claim 3 wherein:

| | |
|---|---|
| Nickel | About 17% by weight |
| Chromium | About 13.5% |
| Molybdenum | About 7.5% |

-continued

| | |
|---|---|
| Copper | About 2% |
| Manganese | About 2.5% |
| Nitrogen | About 0.12% |
| Carbon | About 0.02% |
| Silicon | About 0.7%. |

9. An alloy of claim 3 wherein:

| | |
|---|---|
| Nickel | About 19% by weight |
| Chromium | About 15% |
| Molybdenum | About 8% |
| Copper | About 1% |
| Manganese | About 2% |

-continued

| | |
|---|---|
| Nitrogen | About 0.15% |
| Carbon | About 0.02% |
| Silicon | About 0.6%. |

10. An alloy of claim 3 wherein:

| | |
|---|---|
| Nickel | About 20% by weight |
| Chromium | About 14% |
| Molybdenum | About 9% |
| Copper | About 1% |
| Manganese | About 4% |
| Nitrogen | About 0.2% |
| Carbon | About 0.02% |
| Silicon | About 0.5%. |

* * * * *